US006000547A

United States Patent [19]

Ovadia et al.

[11] Patent Number: 6,000,547

[45] Date of Patent: Dec. 14, 1999

[54] JEWELRY TRAY WITH CHANNELS FOR HOLDING PINS OF JEWELRY HOLDERS

[75] Inventors: Joseph Ovadia, Little Falls; Cezary Babiarz, Lincoln Park, both of N.J.

[73] Assignee: Ovadia Corp., Little Falls, N.J.

[21] Appl. No.: 09/197,185

[22] Filed: Nov. 20, 1998

[51] Int. Cl.[6] ..... B65D 1/34

[52] U.S. Cl. ..... 206/566; 206/6.1; 211/85.2

[58] Field of Search ..... 206/6.1, 477, 488, 206/495, 566; 211/85.2

[56] References Cited

U.S. PATENT DOCUMENTS

| | | | |
|---|---|---|---|
| 2,647,624 | 8/1953 | Sedgwick | 206/6.1 |
| 2,788,123 | 4/1957 | Levis et al. | 206/6.1 |
| 4,650,077 | 3/1987 | Droz | 206/566 |
| 5,775,484 | 7/1998 | Ovadia | 206/6.1 |

*Primary Examiner*—David T. Fidei
*Attorney, Agent, or Firm*—Richard M. Goldberg

[57] ABSTRACT

A jewelry tray includes a frame having an upper surface with a plurality of channels in the upper surface, and the channels cross each other at junctures, each channel having a width, and the junctures having an opening dimension larger than the width; and a plurality of jewelry supports removably mountable on the frame, each jewelry support including a jewelry holder for holding a jewelry item thereon, the jewelry holder including a substantially C-shaped elastic member for holding a watch, and a pin mount secured to the jewelry holder and removably positionable only at the junctures for mounting the jewelry support on the frame such that the jewelry holder is positioned above the upper surface, each pin mount including a securing member secured to the jewelry holder, the securing member having a non-circular configuration with a first dimension less than the width so as to be positionable in the channels and a second dimension greater than the width so as to prevent rotation of the securing member in the channels, and a pin section secured to a lower end of the securing member, the pin section having an outer dimension greater than the width and less than the opening dimension of the junctures, wherein the pin section can only fit within a juncture and the securing member prevents rotation of the pin section in the juncture.

17 Claims, 4 Drawing Sheets

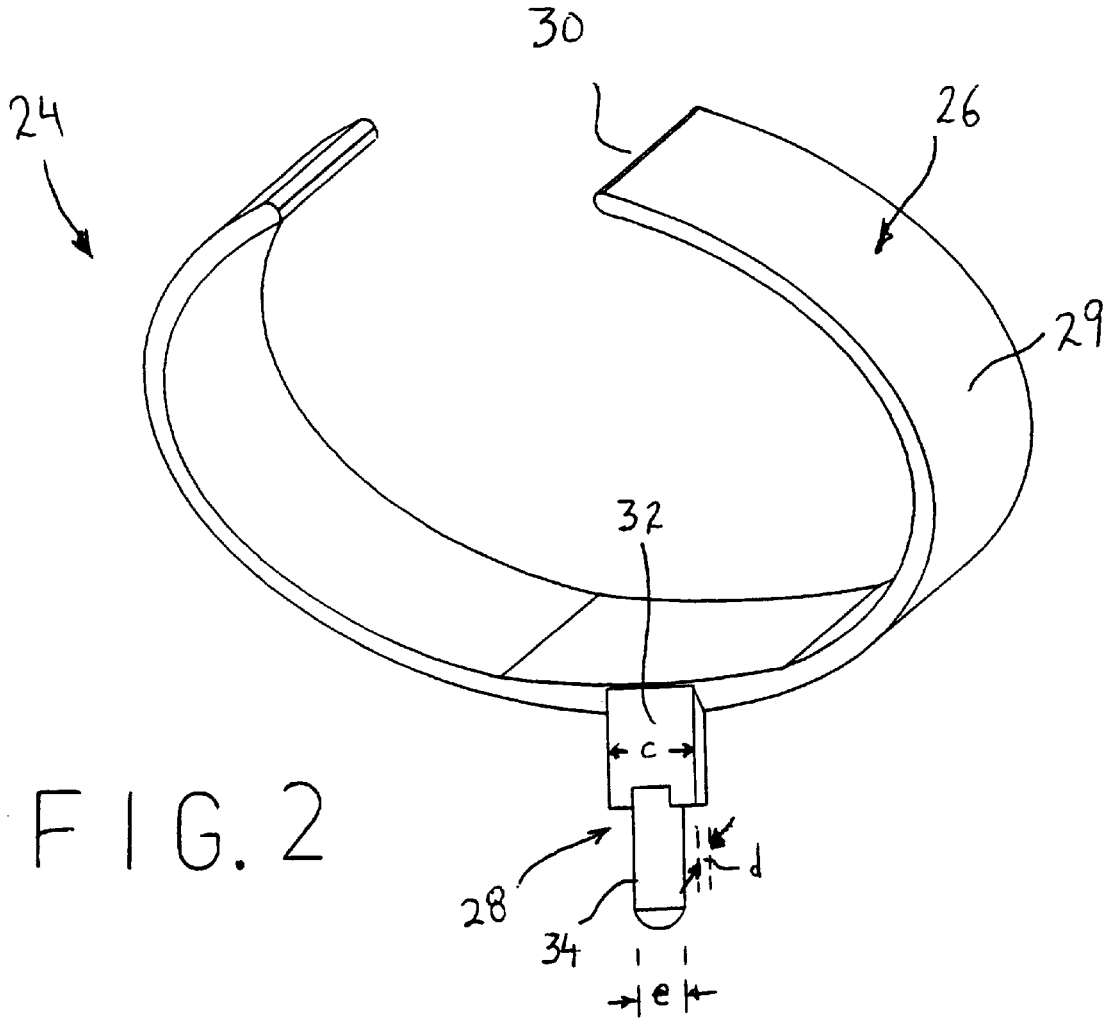
FIG. 2
FIG. 3
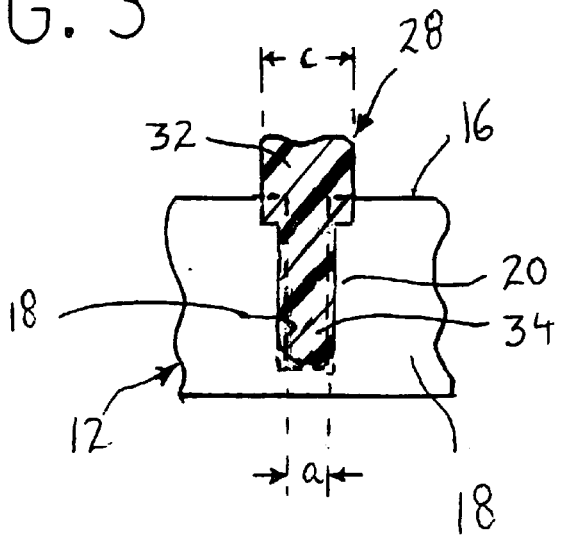

JEWELRY TRAY WITH CHANNELS FOR HOLDING PINS OF JEWELRY HOLDERS

BACKGROUND OF THE INVENTION

The present invention relates generally to display and storage devices, and more particularly, is directed to a jewelry tray for storing and displaying jewelry items, such as rings, watches, etc.

It is know to display jewelry items on pads removably mounted in trays. The pads are made from plastic, cardboard or foam rubber, and are usually covered with some kind of fabric or flocking to give a plush look for the aesthetic demands of the jewelry display, with a layer of foam under the flocking or fabric.

However, these various pads have basic drawbacks. Specifically, plastic and cardboard pads tend to fall out of the trays, while foam rubber pads eventually lose memory from long term pressure. All of these pads became marred, dirty, ugly and eventually have to be replaced.

Further, there is the extra cost of the pads themselves.

Other types of jewelry trays mount the jewelry items directly on the trays. For example, a ring tray is known having a rectangular frame with a central rectangular opening therein and an inwardly extending peripheral ledge. A bottom closing member is secured to the tray so as to close the underside of the tray, and is formed with a plurality of recesses therein in a generally honeycomb pattern. A top pad is secured to and closes the top of the tray. In this known ring tray, the top pad includes a thin lower sheet made of a rubber or similar material that is glued to the peripheral ledge of the frame, the lower sheet having a plurality of die cut slits formed therein which are aligned with each recess. In this manner, a ring can be pushed through a slit in the lower sheet so that it is held by the rubber material and seats in a recess. In order to provide an aesthetic appearance, an upper fabric pad having a plurality of openings is adhered to the upper surface of the lower sheet so that openings in the upper fabric pad are aligned with the slits in the lower sheet.

However, with such known ring tray, one-half of the ring is hidden from view in the top pad where it is held. Further, such arrangement is unnecessarily costly and not entirely effective.

OBJECTS AND SUMMARY OF THE INVENTION

Accordingly, it is an object of the present invention to provide a jewelry tray that overcomes the problems with the aforementioned prior art.

It is another object of the present invention to provide a jewelry tray in which the jewelry items are mounted on jewelry supports at a raised position above the jewelry tray.

It is still another object of the present invention to provide such a jewelry tray in which the jewelry supports are releasably mounted in grooves or holes in the jewelry tray.

It is yet another object of the present invention to provide a jewelry tray which can accommodate different types of jewelry items with different jewelry supports.

It is a further object of the present invention to provide a jewelry tray that is easy and economical to manufacture and use.

In accordance with an aspect of the present invention, a jewelry tray includes a frame having an upper surface with a plurality of channels in the upper surface; and a plurality of jewelry supports removably mountable on the frame, each jewelry support including a jewelry holder for holding a jewelry item thereon, and a pin mount secured to the jewelry holder and removably positionable in one channel for mounting the jewelry support on the frame such that the jewelry holder is positioned above the upper surface.

In one embodiment, the channels cross each other at junctures and the pin mounts are removably positionable only at the junctures. In such case, each channel has a width, the junctures have an opening dimension larger than the width, and the pin mounts have a lower diameter greater than the width but not greater than the opening dimension.

Specifically, each pin mount includes a securing member secured to the jewelry holder, the securing member having a non-circular configuration with a first dimension less than the width so as to be positionable in the channels and a second dimension greater than the width so as to prevent rotation of the securing member in the channels; and a pin section secured to a lower end of the securing member, the pin section having an outer dimension greater than the width and less than the opening dimension of the junctures, wherein the pin section can only fit within a juncture and the securing member prevents rotation of the pin section in the juncture. Preferably, the securing member has a generally parallelepiped configuration.

In another embodiment, each channel includes at least one opening in a bottom wall thereof for receiving the pin mount. In such case, each channel has a width, each opening has an opening dimension, and each pin mount has a lower diameter less than the width and the opening dimension so as to removably fit within each opening.

Specifically, each pin mount includes a securing member secured to the jewelry holder and having an outer dimension greater than the width to limit the extent of insertion of the pin mount in the opening, and a pin section secured to a lower end of the securing member, the pin section having an outer dimension less than the width and less than the opening dimension so as to removably fit within each opening. The securing member can have a cylindrical or non-cylindrical configuration and the pin section has a cylindrical configuration.

In either embodiment, the jewelry holder can take various shapes. In one form, the jewelry holder includes a substantially C-shaped elastic member for holding a jewelry item, and the pin mount is secured to a central portion of the C-shaped elastic member. In another form, the jewelry holder includes a molded ring holder formed as a thin walled, resilient structure in a part cylindrical configuration that extends at an acute angle from the pin mount, and has opposite free edges and an open, upper end.

In accordance with another aspect of the present invention, a jewelry tray includes a frame having an upper surface with a plurality of channels in the upper surface, and the channels cross each other at junctures, each channel having a width, and the junctures having an opening dimension larger than the width; and a plurality of jewelry supports removably mountable on the frame, each jewelry support including a jewelry holder for holding a jewelry item thereon, and a pin mount secured to the jewelry holder and removably positionable only at the junctures for mounting the jewelry support on the frame such that the jewelry holder is positioned above the upper surface, each pin mount including a securing member secured to the jewelry holder, the securing member having a non-circular configuration with a first dimension less than the width so as to be positionable in the channels and a second dimension greater than the width so as to prevent rotation of the securing member in the channels, and a pin section secured to a lower end of the securing member, the pin section having an outer dimension greater than the width and less than the opening dimension of the junctures, wherein the pin section can only fit within a juncture and the securing member prevents rotation of the pin section in the juncture.

In accordance with still another aspect of the present invention, a jewelry tray includes a frame having an upper surface with a plurality of channels in the upper surface, each channel including at least one opening in a bottom wall thereof for receiving the pin mount, each channel having a width, and each opening having an opening dimension; and a plurality of jewelry supports removably mountable on the frame, each jewelry support including a jewelry holder for holding a jewelry item thereon, and a pin mount secured to the jewelry holder and removably positionable in one channel for mounting the jewelry support on the frame such that the jewelry holder is positioned above the upper surface, each pin mount including a securing member secured to the jewelry holder and having an outer dimension greater than the width to limit the extent of insertion of the pin mount in the opening, and a pin section secured to a lower end of the securing member, the pin section having an outer dimension less than the width and less than the opening dimension so as to removably fit within each opening.

The above and other objects, features and advantages of the invention will become readily apparent from the following detailed description thereof which is to be read in connection with the accompanying drawings.

BRIEF DESCRIPTION OF THE DRAWINGS

FIG. 2 is a perspective view of a watch support for removable mounting in the jewelry tray;

FIG. 3 is a cross-sectional view of a portion of the jewelry tray of FIG. 1, taken along a channel, with the support of FIG. 2 mounted therein;

DETAILED DESCRIPTION

Figure 1:
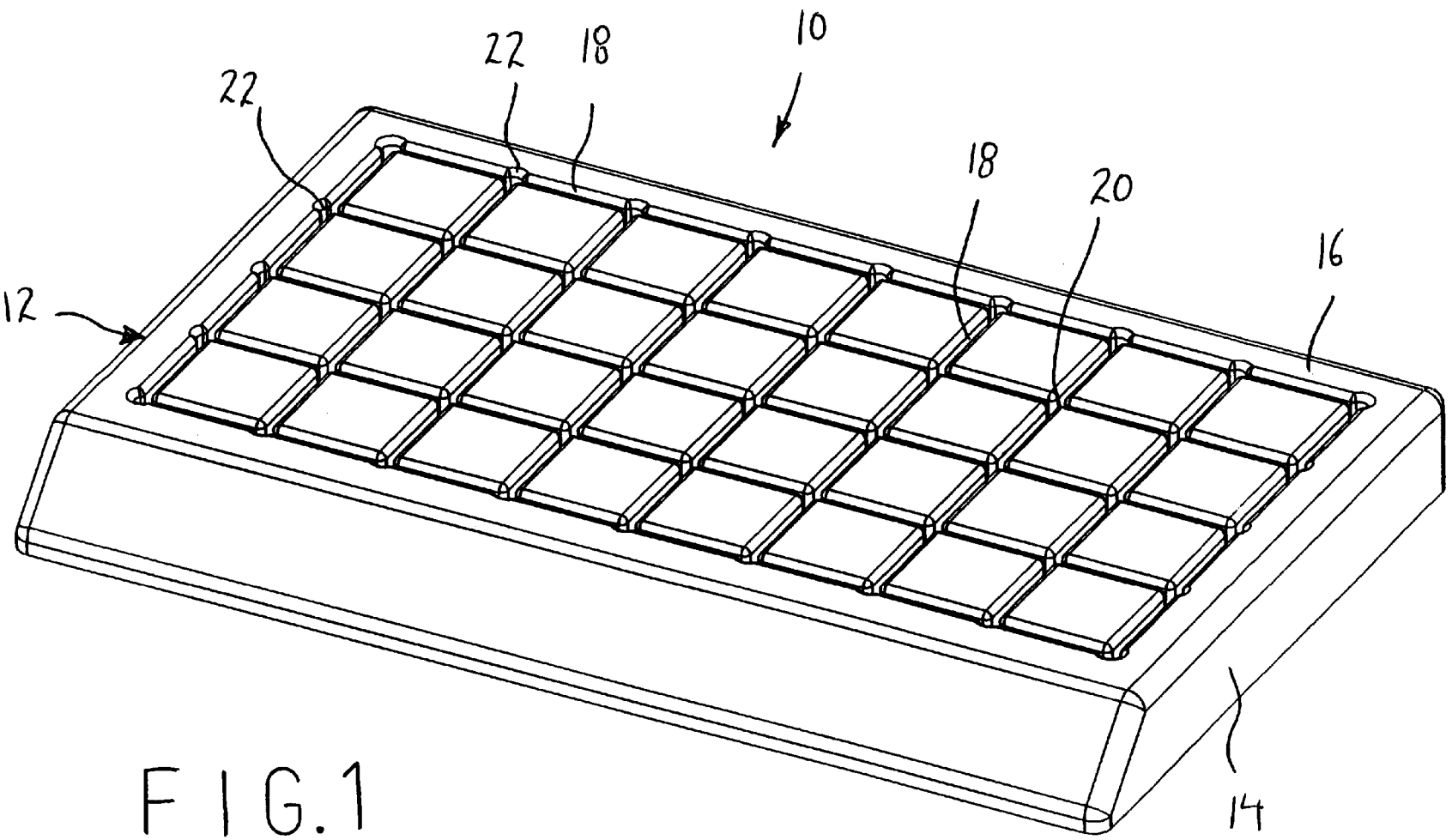
FIG. 1 is a perspective view of a jewelry tray according to a first embodiment of the present invention.

Referring to the drawings in detail, a jewelry tray 10 according to the present invention includes a generally rectangular, solid frame 12 made from any suitable material, such as a tough, lightweight plastic, wood, etc. Although. frame 12 is shown in a rectangular configuration, it is not so limited, and can take any suitable form. As shown, frame 12 includes a peripheral side wall 14, which is formed in a substantially rectangular configuration and has curved upper sides, and an upper planar surface 16.

A plurality of channels 18 that criss-cross each other at right angles are formed in frame 12 and are open at upper surface 16. Thus, various junctures 20 are provided at the intersection of channels 18. Each channel 18 has a width equal to "a" and can therefore accommodate a cylindrical pin of the same or smaller diameter. However, because of the criss-crossing nature, and using the Pythagorean theorem, each juncture 20 can accommodate a cylindrical pin of a larger diameter "b" which is equal to or smaller than 1.414 x "a". In addition, the ends of each channel 18 extend slightly beyond the respective crossed channels 18 in order to define end recesses 22, which ensure that even the criss-crossed ends of channels 18 can accommodate a cylindrical pin having a diameter equal to or smaller than "b". The above is best shown in FIG. 3.

A jewelry support 24 is provided with a jewelry holder 26 secured to a pin mount 28. In the embodiment shown, jewelry holder 26 includes a C-shaped plastic member 29 for holding a watch. In such case, the watch band of the watch is stretched around jewelry holder 26 and held thereon, with the watch face positioned at the opening 30 of C-shaped plastic member 29.

Pin mount 28 is connected at one edge of C-shaped plastic member 29 and centrally along the length thereof. Pin mount 28 includes an upper, generally parallelepiped member 32 having its upper end connected with jewelry holder 26 at the aforementioned position, and a cylindrical pin 34 secured to the lower end of member 32 and extending downwardly therefrom. Parallelepiped member 32 has a generally rectangular configuration in transverse sectional view. Thus, member 32 has a length "c" and a width "d". The length "c" is greater than the distance "b" at each juncture 20, while the width "d" is less than the width "a" of a channel 18. In this regard, member 32 can fit within a channel 18 but is not rotatable in a channel 18 or at a juncture 20. The diameter "e" of pin 34 is greater than the width "a" of a channel 18, but less than the distance "b" at juncture 20. In this regard, pin 34 can only fit in frame 2 at a juncture 20.

With this arrangement, pin 34 limits the positioning of in mount 28 to a juncture 20, while member 32 prevents rotation of jewelry support 24 in the juncture 20. Accordingly, jewelry support 24 can be positioned in only one of four facing directions which are 90 degrees offset from each other.

With this arrangement, an item of jewelry can be held by jewelry support 24 at a position above upper planar surface 16 in one of four directions, and can be easily removed from jewelry tray 10.

Figure 7:
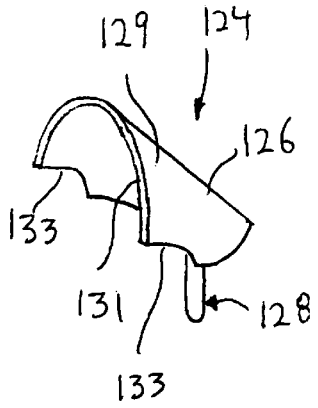
FIG. 7 is a perspective view of a ring support for removable mounting in the jewelry tray of FIG. 4.
Figure 8:
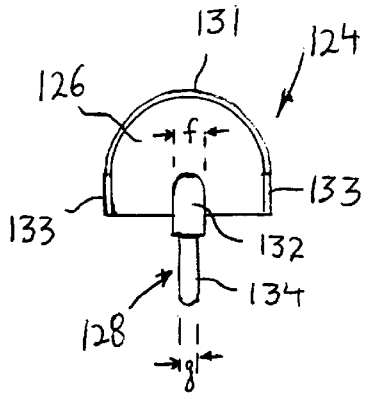
FIG. 8 is a front elevational view of the ring support of FIG. 7.
Figure 9:
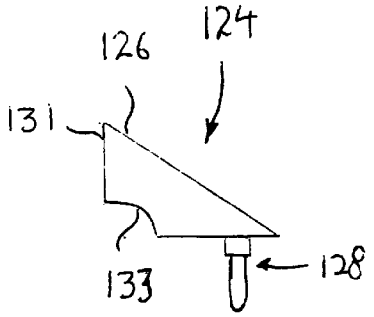
FIG. 9 is a side elevational view of the ring support of FIG. 7.
Figure 10:
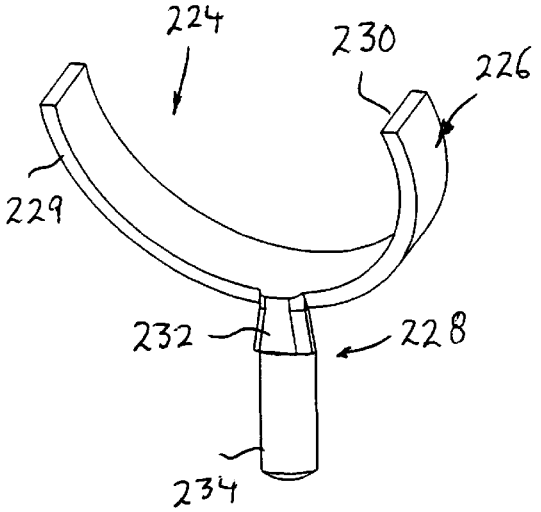
FIG. 10 is a perspective view of a watch support for removable mounting in the jewelry tray of FIG. 4.

It will be appreciated that jewelry holder 26 can take any suitable form, such as the ring holder of FIGS. 7–9, the watch holder of FIG. 10, or the like.

Figure 4:
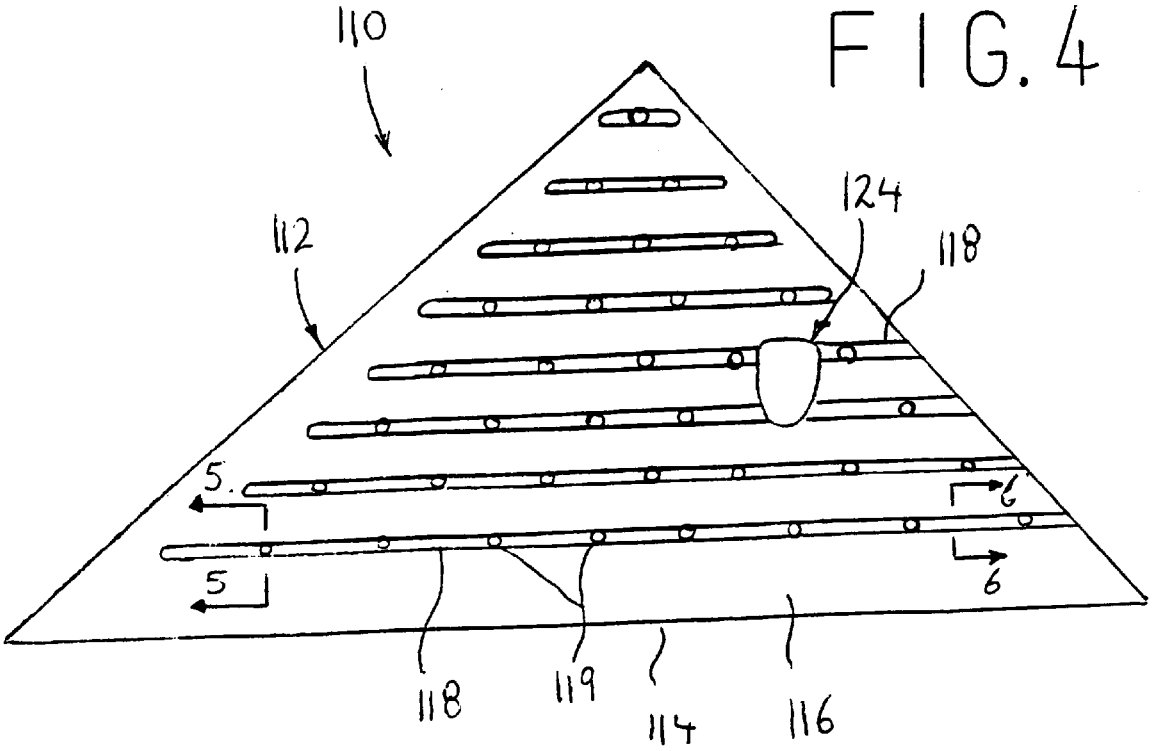
FIG. 4 is a perspective view of a jewelry tray according to a second embodiment of the present invention.
Figure 5:
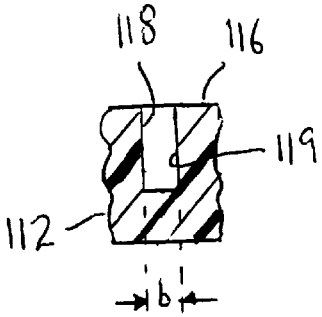
FIG. 5 is a cross-sectional view of the jewelry tray of FIG. 4, taken along line 5—5 thereof.
Figure 6:
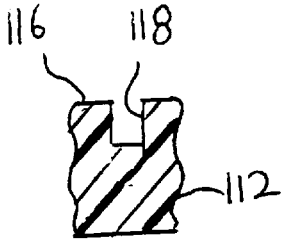
FIG. 6 is a cross-sectional view of the jewelry tray of FIG. 4, taken along line 6—6 thereof.

Referring now to FIGS. 4–6, a jewelry tray 110 according to a second embodiment of the present invention is shown. Jewelry tray 110 includes a generally triangular solid frame 112 made from any suitable material, such as a tough, lightweight plastic, wood, etc. Although frame 112 is shown in a triangular configuration, it is not so limited, and can take any suitable form. As shown, frame 112 includes a peripheral side wall 114, which is formed in a substantially triangular configuration and an upper planar surface 116.

A plurality of parallel channels 118 are formed in frame 112 and are open at upper surface 116. Each channel 118 has a width equal to "b", which is the same dimension as junctures 20 of the jewelry tray 10. Each channel 118 can therefore accommodate a cylindrical pin of the same or smaller diameter, such as cylindrical pin 34 of FIG. 2. Each channel 118 is provided with at least one, and preferably a plurality of spaced cylindrical openings 119 in the bottom wall thereof. Preferably, each opening 119 has a diameter "b" equal to the width of the respective channel 118, although the invention is not limited thereto.

Preferably, one end of some of the channels 118 is open to peripheral side wall 114, although the present invention is not so limited.

A jewelry support 124 is provided with a jewelry holder 126 secured to a pin mount 128. In the embodiment shown in FIGS. 4 and 7–9, jewelry holder 126 includes a molded ring holder 129, which is formed as a thin walled structure in a part cylindrical configuration that extends upwardly at an acute angle of, for example, 45°, from pin mount 128. This configuration permits a ring to be placed on each ring holder 129. In such case, the wall of ring holder 129 can be compressed, and when a ring is positioned thereon, the wall of ring holder 129, which is resilient, will expand back outwardly so that the ring is securely held thereon.

Each ring holder 129 is preferably integrally molded with pin mount 128. The upper end 131 of each ring holder 129 is open. Preferably, although not essential, the side edges of each ring post 129 are cut-away to provide arcuate edges 133, the lower edges of which are coincident with the lower edge of ring holder 129.

Pin mount 128 is connected centrally at an undersurface of ring holder 129 and toward the rear thereof. Pin mount 128 includes an upper cylindrical pin section 132 having its upper end connected with jewelry holder 126 at the aforementioned position, and a lower cylindrical pin section 134 secured coaxially to the lower end of pin section 132 and extending downwardly therefrom. Upper cylindrical pin section 132 has a diameter "f" which is greater than the width "b" of each channel 118 to limit the extent of insertion of pin mount 128, in order that ring holder 129 sits sufficiently above upper planar surface 116. However, lower cylindrical pin section 134 has a diameter "g" equal to or less than width "b" of each channel 118 and equal to or less than diameter "b" of each opening 119, so as to fit within a respective opening 119. It will be appreciated that, with this embodiment, contrary to the first embodiment, jewelry support 124 is rotatable within an opening 119.

Thus, an item of jewelry can be held by jewelry holder 124 at a position above upper planar surface 116 in any direction, and can be easily removed from jewelry tray 10.

An alternative embodiment of a jewelry support 224 is shown in FIG. 10. Specifically, jewelry support 224 is provided with a jewelry holder 226 secured to a pin mount 228. In the embodiment shown, jewelry holder 226 includes a semi-circular shaped plastic member 229 for holding a ring, a watch or a bracelet. In such case, a watch band is stretched around jewelry holder 226 and held therein, with the watch face positioned at the opening 230 of C-shaped plastic member 229.

Pin mount 228 is connected at one edge of C-shaped plastic member 229 and centrally along the length thereof. Pin mount 228 includes an upper, generally parallelepiped member 232 having its upper end connected with jewelry holder 226 at the aforementioned position, and a cylindrical pin 234 secured to the lower end of member 232 and extending downwardly therefrom. Parallelepiped member 232 has dimensions, in a transverse sectional view, greater than the width "b" of each channel 118, so as to limit the extent of insertion of pin mount 228 in order that semi-circular shaped plastic member 229 sits sufficiently above upper planar surface 116. However, cylindrical pin 234 has a diameter equal to or less than width "b" of each channel 118 and equal to or less than diameter "b" of each opening 119, so as to fit within a respective opening 119. It will be appreciated that, with this embodiment, contrary to the first embodiment, jewelry support 224 is rotatable within an opening 119.

It will be appreciated that the jewelry support of the second embodiment can take any suitable form, such as the watch holder of FIG. 2, the ring holder of FIGS. 7–9, the watch holder of FIG. 10, or the like. For example, jewelry support 24 of FIG. 2 can be used with jewelry tray 110 of FIG. 4. In such case, cylindrical pin 34 would fit within an opening 119, along with a portion of parallelepiped member 32, the latter functioning to prevent rotation of cylindrical pin 34 in opening 119.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A jewelry tray comprising:

a frame having an upper surface with a plurality of channels in said upper surface, said channels crossing each other at junctures; and a plurality of jewelry supports removably mountable on said frame, each said jewelry support including:

a jewelry holder for holding a jewelry item thereon, and a pin mount secured to said jewelry holder and removably positionable in one said channel for mounting said jewelry support on said frame such that said jewelry holder is positioned above said upper surface, said pin mounts being removably positionable only at said junctures.

2. A jewelry tray according to claim 1, wherein:

each said channel has a width, and said junctures have an opening dimension larger than said width, and said pin mounts have a lower diameter greater than said width but not greater than said opening dimension.

3. A jewelry tray according to claim 2, wherein each said pin mount includes:

a securing member secured to said jewelry holder, said securing member having a non-circular configuration with a first dimension less than said width so as to be positionable in said channels and a second dimension greater than said width so as to prevent rotation of said securing member in said channels; and a pin section secured to a lower end of said securing member, said pin section having an outer dimension greater than said width and less than said opening dimension of said junctures, wherein said pin section can only fit within a juncture and said securing member prevents rotation of said pin section in said juncture.

4. A jewelry tray according to claim 3, wherein said securing member has a generally parallelepiped configuration.

5. A jewelry tray comprising:

a frame having an upper surface with a plurality of channels in said upper surface, each said channel including at least one opening in a bottom wall thereof, each said channel having a width, and each said opening having an opening dimension: and a plurality of jewelry supports removably mountable on said frame, each said jewelry support including:

a jewelry holder for holding a jewelry item thereon, and a pin mount secured to said jewelry holder and removably positionable in one said channel for mounting said jewelry support on said frame such that said jewelry holder is positioned above said upper surface, each said pin mount having a lower diameter less than said width and said opening dimension so as to removably fit within each said opening, each said pin mount including:

a securing member secured to said jewelry holder and having an outer dimension greater than said width to limit the extent of insertion of said pin mount in said opening, and a pin section secured to a lower end of said securing member, said pin section having an outer dimension less than said width and less than said opening dimension so as to removably fit within each said opening.

6. A jewelry tray according to claim 5, wherein said securing member and said pin section each have a cylindrical configuration.

7. A jewelry tray according to claim 5, wherein said securing member has a non-cylindrical configuration and said pin section has a cylindrical configuration.

8. A jewelry tray according to claim 1, wherein said jewelry holder include s a substantially C-shaped elastic member for holding a jewelry item, and said pin mount is secured to a central portion of said C-shaped elastic member.

9. A jewelry tray comprising:

a frame having an upper surface with a plurality of channels in said upper surface; and a plurality of jewelry supports removably mountable on said frame, each said jewelry support including:

a jewelry holder for holding a jewelry item thereon, said jewelry holder including a molded ring holder formed as a thin walled, resilient structure in a part cylindrical configuration that extends at an acute angle from said pin mount, and has opposite free edges; and a pin mount secured to said jewelry holder and removably positionable in one said channel for mounting said jewelry support on said frame such that said jewelry holder is positioned above said upper surface.

10. A jewelry case according to claim 9, wherein each said ring holder has an open, upper end.

11. A jewelry tray comprising:

a frame having an upper surface with a plurality of channels in said upper surface, and said channels cross each other at junctures, each said channel having a width, and said junctures having an opening dimension larger than said width; and a plurality of jewelry supports removably mountable on said frame, each said jewelry support including:

a jewelry holder for holding a jewelry item thereon, and a pin mount secured to said jewelry holder and removably positionable only at said junctures for mounting said jewelry support on said frame such that said jewelry holder is positioned above said upper surface, each said pin mount including:

a securing member secured to said jewelry holder, said securing member having a non-circular configuration with a first dimension less than said width so as to be positionable in said channels and a second dimension greater than said width so as to prevent rotation of said securing member in said channels; and a pin section secured to a lower end of said securing member, said pin section having an outer dimension greater than said width and less than said opening dimension of said junctures, wherein said pin section can only fit within a juncture and said securing member prevents rotation of said pin section in said juncture.

12. A jewelry tray according to claim 11, wherein said securing member has a generally parallelepiped configuration.

13. A jewelry tray according to claim 11, wherein said jewelry holder includes a substantially C-shaped elastic member for holding a jewelry item, and said pin mount is secured to a central portion of said C-shaped elastic member.

14. A jewelry tray comprising:

a frame having an upper surface with a plurality of channels in said upper surface, each said channel including at least one opening in a bottom wall thereof, each said channel having a width, and each said opening having an opening dimension; and a plurality of jewelry supports removably mountable on said frame, each said jewelry support including:

a jewelry holder for holding a jewelry item thereon, and a pin mount secured to said jewelry holder and removably positionable in one said channel and one opening for mounting said jewelry support on said frame such that said jewelry holder is positioned above said upper surface, each said pin mount including:

a securing member secured to said jewelry holder and having an outer dimension greater than said width to limit the extent of insertion of said pin mount in said opening, and a pin section secured to a lower end of said securing member, said pin section having an outer dimension less than said width and less than said opening dimension so as to removably fit within each said opening.

15. A jewelry tray according to claim 14, wherein said securing member and said pin section each have a cylindrical configuration.

16. A jewelry tray according to claim 14, wherein said securing member has a non-cylindrical configuration and said pin section has a cylindrical configuration.

17. A jewelry tray according to claim 14, wherein said jewelry holder includes a molded ring holder formed as a thin walled, resilient structure in a part cylindrical configuration that extends at an acute angle from said pin mount, and has opposite free edges.

* * * * *